US008567665B2

(12) United States Patent
Boyes

(10) Patent No.: US 8,567,665 B2
(45) Date of Patent: Oct. 29, 2013

(54) SECURE ENCLOSURE

(75) Inventor: James A. Boyes, Blairgowrie (GB)

(73) Assignee: NCR Corporation, Duluth, GA (US)

( * ) Notice: Subject to any disclaimer, the term of this patent is extended or adjusted under 35 U.S.C. 154(b) by 266 days.

(21) Appl. No.: 12/783,611

(22) Filed: May 20, 2010

(65) Prior Publication Data

US 2011/0283925 A1 Nov. 24, 2011

(51) Int. Cl.
*G07D 11/00* (2006.01)

(52) U.S. Cl.
USPC ..... 235/379

(58) Field of Classification Search
USPC ..... 235/379
See application file for complete search history.

(56) References Cited

U.S. PATENT DOCUMENTS

| | | | | |
|---|---|---|---|---|
| 4,048,926 | A * | 9/1977 | Brush et al. | 109/65 |
| 4,094,110 | A * | 6/1978 | Dickens et al. | 52/81.1 |
| 4,649,832 | A * | 3/1987 | Hain et al. | 109/24.1 |
| 6,282,853 | B1 * | 9/2001 | Blaney et al. | 52/223.7 |
| 2012/0148806 | A1 * | 6/2012 | Dubey et al. | 428/193 |

* cited by examiner

*Primary Examiner* — Jamara Franklin
(74) *Attorney, Agent, or Firm* — Kevin P. Belote

(57) ABSTRACT

A method of constructing a secure enclosure body is disclosed. The method comprises providing a molded plastic shell body incorporating a mesh reinforcement; coupling a mold to the molded plastic shell to define a cavity between the mold and the molded plastic shell; inserting concrete into the cavity; and removing the mold when the concrete has sufficiently set to provide a secure enclosure body.

6 Claims, 6 Drawing Sheets

SECURE ENCLOSURE

FIELD OF INVENTION

The present invention relates to improvements in or relating to a secure enclosure.

BACKGROUND OF INVENTION

Secure enclosures, such as safes, strongrooms, and vaults, are typically used to store valuable items. One particular application of a secure enclosure is as a composite safe for housing valuable components of an automated teller machine (ATM), such as a cash dispenser, a cash acceptance module, and the like. The value of such components is principally derived from the large amounts of cash stored within them.

Typical composite safes comprise an inner and outer layer of steel sandwiching a reinforced high density concrete layer. During construction of a composite safe, the inner and outer layers of steel are used to create a cavity into which the high density concrete is poured.

One disadvantage of composite safes is that they are expensive to manufacture.

SUMMARY OF INVENTION

Accordingly, the invention generally provides methods and apparatus for a secure enclosure.

In addition to the Summary of Invention provided above and the subject matter disclosed below in the Detailed Description, the following paragraphs of this section are intended to provide further basis for alternative claim language for possible use during prosecution of this application, if required. If this application is granted, some aspects of the invention may relate to claims added during prosecution of this application, other aspects may relate to claims deleted during prosecution, other aspects may relate to subject matter never claimed. Furthermore, the various aspects detailed hereinafter are independent of each other, except where stated otherwise. Any claim corresponding to one aspect should not be construed as incorporating any element or feature of the other aspects unless explicitly stated in that claim.

According to a first aspect there is provided a method of constructing a secure enclosure body, the method comprising:

providing a molded plastic shell body incorporating a mesh reinforcement;

coupling a mould to the molded plastic shell to define a cavity between the mould and the molded plastic shell;

inserting concrete into the cavity; and removing the mould when the concrete has sufficiently set to provide a secure enclosure body.

As used herein, "sufficiently set" refers to when the concrete or plastic has hardened to a state where it is self-supporting.

The step of providing a molded plastic shell body may further comprise the sub-steps of: providing a shell mould defining a shell cavity; placing the mesh reinforcement into the shell cavity; injecting plastic into the shell cavity; and removing the shell mould, when the plastic has sufficiently set, to provide a molded plastic shell.

The sub-step of providing a shell mould defining a shell cavity may further comprise providing a shell mould defining sidewalls and a protrusion extending therefrom. The protrusion forms a complementary protrusion in the molded plastic shell body into which the concrete can flow when poured therein.

The method may comprise the further step of: placing an additional reinforcement within the cavity between the mold and the molded plastic shell, prior to the step of inserting concrete into the cavity.

The method may comprise the further step of providing a surface decoration on one or more inner surfaces of the mould prior to inserting concrete into the cavity, so that the concrete is provided with one or more external surfaces having a surface decoration. The surface decoration may comprise a stipple pattern, a wave pattern, or the like. This has the advantage that the concrete can be provided with a decorative surface finish.

The method may further comprise coupling a secure enclosure door to the secure enclosure body. The door may comprise a door leaf, a boltwork casing, and other conventional features of a secure enclosure door.

The method may further comprise the step of heating the mould prior to, during, or immediately subsequent to inserting concrete into the cavity. By heating the mould, the curing time for the concrete may be reduced.

The concrete may include a pigment to provide a colored finish.

The concrete may comprise a quick-setting concrete. The quick-setting concrete may comprise natural concrete (made from natural cement rather than Portland cement) or polymer concrete.

As is known to those of skill in the art, polymer concrete uses one or more resins instead of cement.

By using polymer concrete instead of cementious (that is, cement-based) concrete, a strong bond is provided between the molded plastic shell and the polymer concrete. This is in contrast to prior art composite safes in which the concrete does not adhere to the inner and outer steel layers.

By using quick-setting concrete the cure times required for the concrete to set are shorter than for cement-based concrete, thereby reducing the construction time and saving money.

By avoiding having to use steel inner and outer layers, the resulting secure enclosure body is lighter than a corresponding secure enclosure body that uses steel inner and outer layers. This may make shipping and handling speedier and less expensive.

According to a second aspect there is provided a secure enclosure body, the body comprising:

a molded plastic shell body incorporating a mesh reinforcement; and concrete adhered to the molded plastic shell body.

The concrete may be quick-setting concrete. The quick-setting concrete may comprise natural concrete or polymer concrete.

According to a third aspect there is provided a secure enclosure comprising: the secure enclosure body of the second aspect; and a secure enclosure door leaf coupled to the secure enclosure body.

The secure enclosure may further comprise: a boltwork casing coupled to the door leaf, where the boltwork casing encloses a lock mechanism, and engagement bars. A handle may also be coupled to the door leaf.

According to a fourth aspect there is provided a secure enclosure body made by the method of the first aspect.

According to a fifth aspect there is provided a self-service terminal comprising a dispenser mounted in a secure enclosure according to the third aspect.

The self-service terminal may be an automated teller machine (ATM), an information kiosk, a financial services centre, a bill payment kiosk, a lottery kiosk, a postal services machine, a check-in and/or check-out terminal such as those used in the retail, hotel, car rental, gaming, healthcare, and airline industries, and the like.

According to a sixth aspect there is provided a business hours secure enclosure comprising a molded plastic shell body incorporating a mesh reinforcement; and a secure enclosure door leaf coupled to the molded plastic shell body.

The mesh reinforcement may comprise steel having a width of at least three millimeters.

According to a seventh aspect there is provided a composite secure enclosure body consisting essentially of a molded plastic shell body incorporating a mesh reinforcement; and concrete adhered to the molded plastic shell body and incorporating additional reinforcement.

By virtue of this aspect of the invention a composite safe can be provided that does not have an inner and outer layer of steel, thereby reducing costs.

For clarity and simplicity of description, not all combinations of elements provided in the aspects recited above have been set forth expressly. Notwithstanding this, the skilled person will directly and unambiguously recognize that unless it is not technically possible, or it is explicitly stated to the contrary, the consistory clauses referring to one aspect are intended to apply mutatis mutandis as optional features of every other aspect to which those consistory clauses could possibly relate.

These and other aspects will be apparent from the following specific description, given by way of example, with reference to the accompanying drawings.

DETAILED DESCRIPTION

Figure 1:
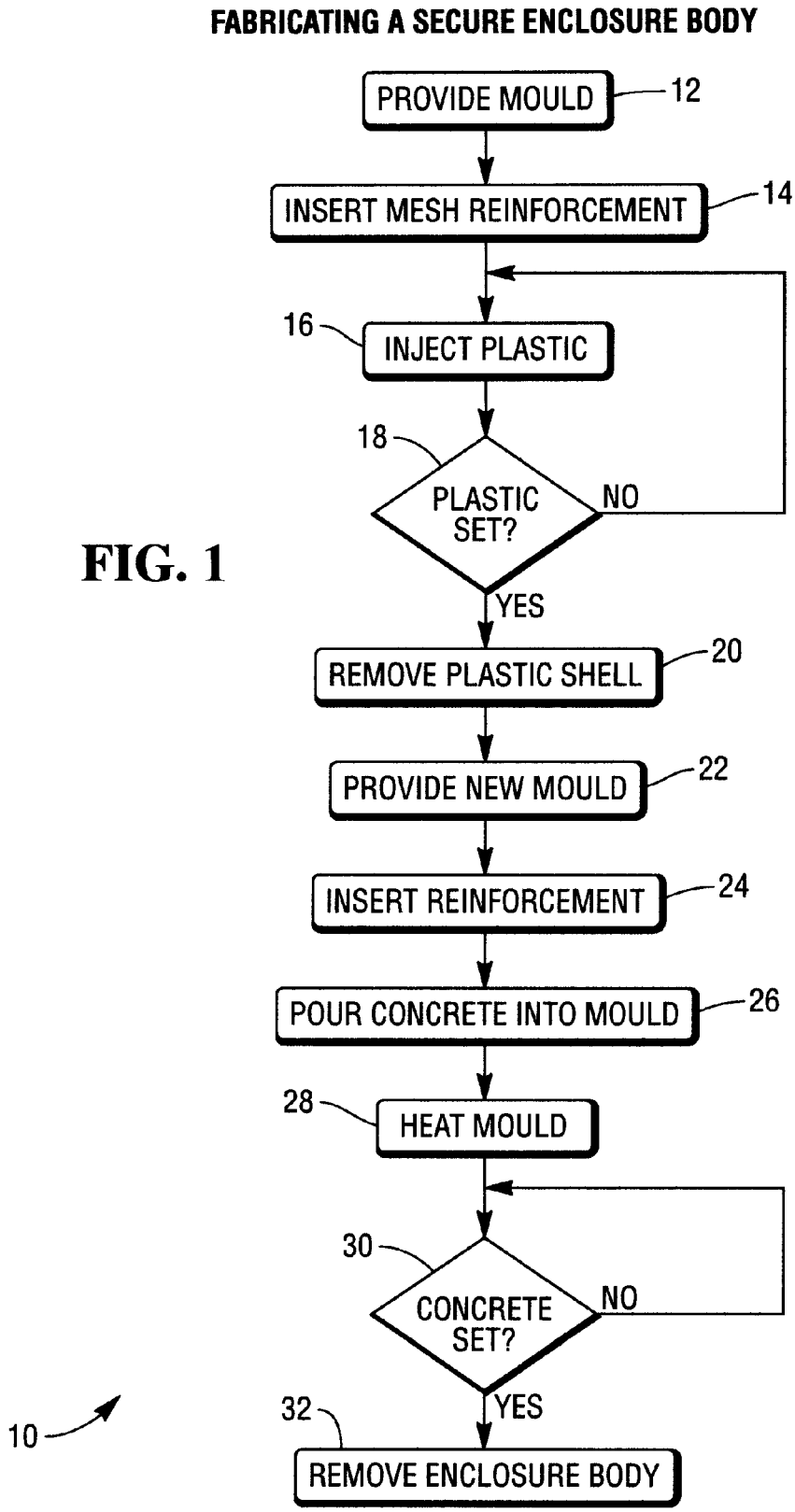
FIG. 1 is a flowchart illustrating process steps used to fabricate a secure enclosure according to one embodiment of the present invention.

Reference is first made to FIG. 1, which is a flowchart 10 illustrating process steps used to fabricate a secure enclosure according to one embodiment of the present invention.

The first step (step 12) in the process is to provide a shell mould (not shown) defining a cavity (not shown).

The next step (step 14) is to insert a mesh reinforcement (not shown in FIG. 1) into the cavity (not shown). Once the mesh reinforcement (not shown in FIG. 1) is in place, the next step (step 16) is to inject molten plastic (polycarbonate in this embodiment) into the cavity (not shown).

The molten plastic is then allowed to set (step 18). Once set, the mould is then removed (step 20) to reveal a secure enclosure body part (not shown in FIG. 1), in the form of a molded plastic shell body. The molded plastic shell body corresponds to the shape defined by the cavity (not shown).

Figure 2:
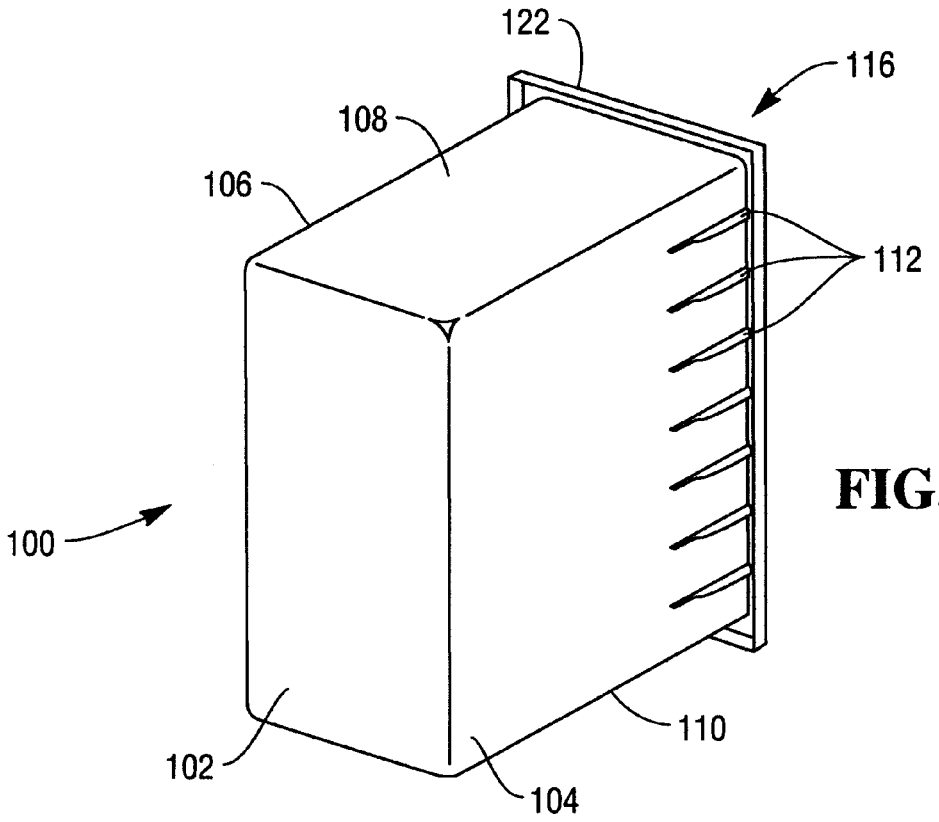
FIG. 2 is a rear perspective view of a secure enclosure body part (a molded plastic shell body) according to one embodiment of the invention resulting from a step of the process of FIG. 1.

Reference is now also made to FIG. 2, which is a rear perspective view of the molded plastic shell body 100 produced after step 20 of the fabrication process.

The molded plastic shell body 100 comprises a rear wall 102, opposing vertical sidewalls 104,106 coupled to the rear wall 102, and an upper wall 108 and a lower wall 110, both coupled to the rear wall 102.

The opposing vertical sidewalls 104,106 both define a plurality of ribs 112 on external surfaces thereof. The ribs 112 complement recesses provided in the shell mould (not shown) and were defined when the plastic was injected therein.

Figure 3:
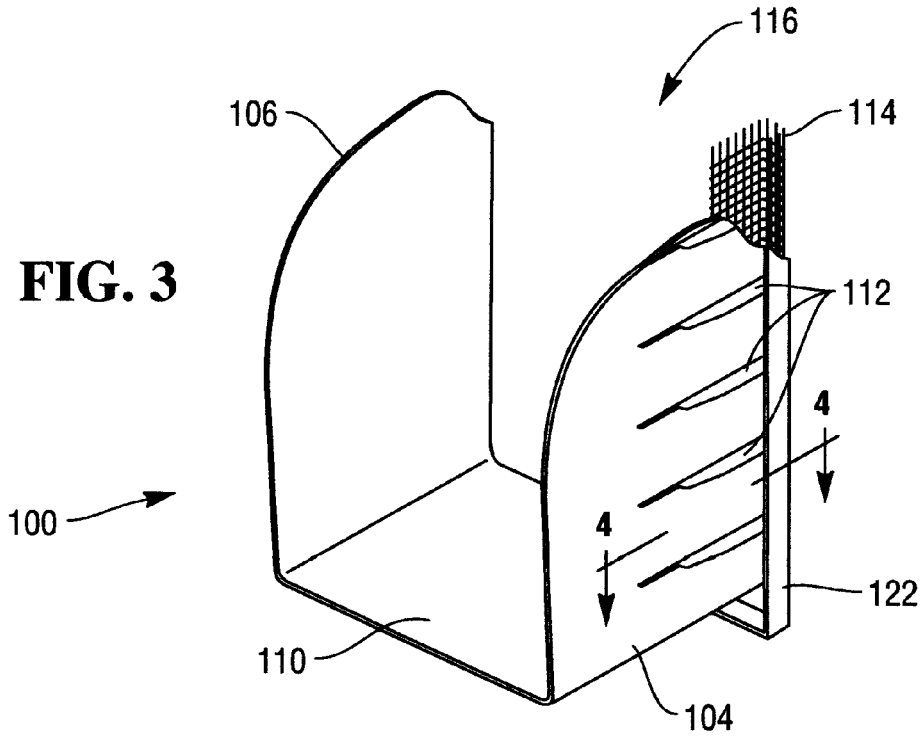
FIG. 3 is a rear perspective view of the molded plastic shell body of FIG. 2 with some of the plastic removed to reveal a mesh reinforcement embedded therein.

Reference is now also made to FIG. 3, which is a rear perspective view of the molded plastic shell body 100 with some of the plastic removed (the rear wall 102 is not shown) to reveal a mesh reinforcement 114 enclosed therein. For clarity, the mesh reinforcement 114 is shown covering only a portion of the sidewall 104 even though it extends around all of the sidewalls 104,106,108,110 and the rear wall 102.

The opposing vertical sidewalls 104,106, the upper wall 108, and the lower wall 110 (collectively referred to herein as the four sidewalls) together define an opening 116 (best seen in FIG. 2) that will subsequently be closed by a secure enclosure (safe) door. An edge of each of the four sidewalls 104, 106,108,110 is formed into a continuous protrusion 122 (as a result of the shape of the shell mould) surrounding the opening 116.

Figure 4:
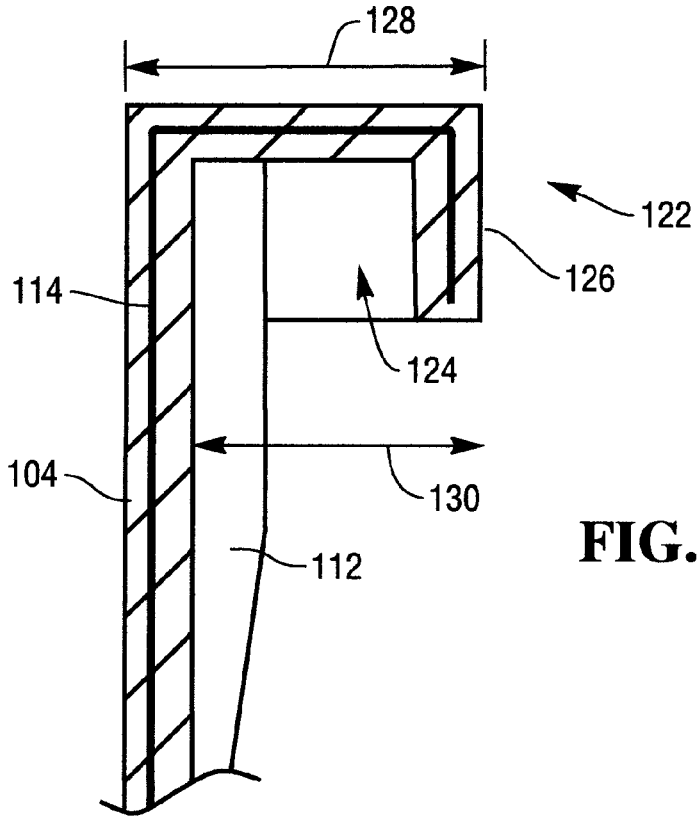
FIG. 4 is a cross-sectional plan view of part of the molded plastic shell body of FIG. 2.

The protrusion 122 is shown in more detail in FIG. 4, which is a cross-section plan view showing part of the protrusion 122 in more detail. The protrusion 122 extends transverse to, and provides a perimeter for, the four sidewalls 104,106,108, 110.

The protrusion 122 has a generally c-shaped cross-section, and defines a channel 124 between a flange 126 of the protrusion 122 and the sidewall adjacent the protrusion 122. Vertical sidewall 104 is the sidewall closest to the protrusion 122 in the portion of the molded plastic shell body 100 shown in FIG. 4.

The protrusion 122 has a width (shown by double-headed arrow 128) selected to match a desired final wall thickness of a secure enclosure body. The distance between the respective sidewall and the flange 126 is referred to herein as the concrete fill depth and is shown by double-headed arrow 130. In this embodiment, the desired final composite secure enclosure width is approximately 40 mm. The sidewalls are approximately 6 mm thick (not counting the width of the ribs 112), and the concrete fill depth is approximately 34 mm.

During step 14 of the fabrication process, the mesh reinforcement 114 was inserted into the shell mould cavity (not shown) in such a way as to ensure that the injected plastic completely covers all of the mesh reinforcement 114 so that the mesh reinforcement 114 is not visible when the molded plastic shell body 100 is removed from the shell mould cavity (not shown). This ensures that the mesh reinforcement 114 is embedded within the rear wall 102, the four plastic sidewalls 104,106,108,110, and the protrusion 122.

In this embodiment, the mesh reinforcement 114 comprises an array of steel wires disposed horizontally and vertically to form a lattice. The wires are approximately 3 mm in diameter and spaced approximately 18 mm apart in the horizontal and vertical directions.

Returning now to FIG. 1, the next step in the process is to surround the molded plastic shell body 100 with a new mould (step 22). To implement this, the molded plastic shell body 100 is placed resting on the protrusion 122 with the opening 116 downwards.

The first mould (used in step 12) is referred to as the "plastic mould" because it is used to receive plastic injected therein. The second mould (used in step 22) is referred to as the "concrete mould" because it is used to receive polymer concrete poured therein.

The concrete mould (not shown) abuts the flange 126 of the protrusion 122 and extends upwards beyond the rear wall 102 by a distance approximately equal to the concrete fill depth 130. The concrete mould (not shown) includes a surface stipple pattern on an inner surface to provide an attractive external surface finish on any concrete poured therein.

Figure 5:
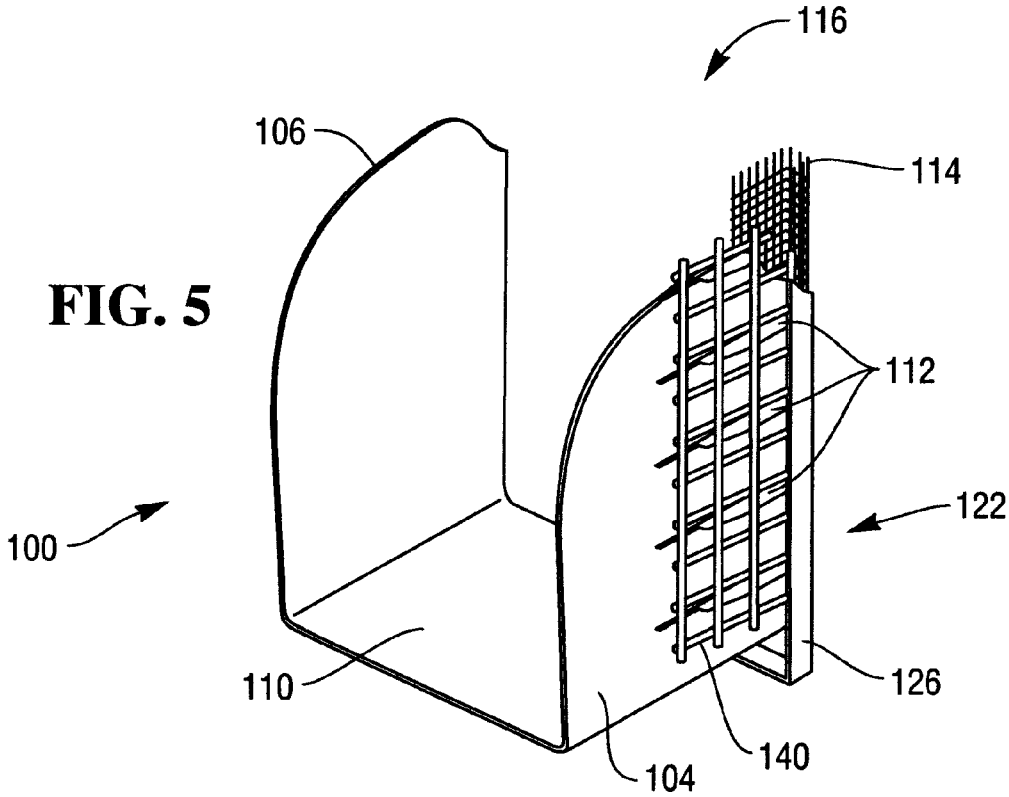
FIG. 5 is a rear perspective view of the molded plastic shell body of FIG. 2 showing an additional reinforcement for added security located beside the molded plastic shell body prior to another step of the process of FIG. 1.

Reference will now also be made to FIG. 5, which is a rear perspective view of the molded plastic shell body 100 showing an additional reinforcement 140 for added security. The additional reinforcement 140 comprises a steel lattice having horizontal and vertical steel wires of approximately 10 mm in diameter and spaced approximately 50 mm apart in the horizontal and vertical directions.

Returning to FIG. 1, the next step in the fabrication process (step 24) is to insert the additional reinforcement 140 (FIG. 5) into a cavity (not shown) defined between the molded plastic shell body 100 and the concrete mould (not shown). For simplicity and clarity, FIG. 5 only illustrates part of the additional reinforcement 140.

Once the additional reinforcement 140 has been inserted, the next step in the process (step 26) is to pour polymer concrete into the cavity (not shown) defined by the molded plastic shell body 100 and the concrete mould (not shown). Any convenient polymer concrete may be used.

The next step, which is optional, is to heat the concrete mould (step 28) to reduce the curing time for the polymer concrete.

Figure 6:
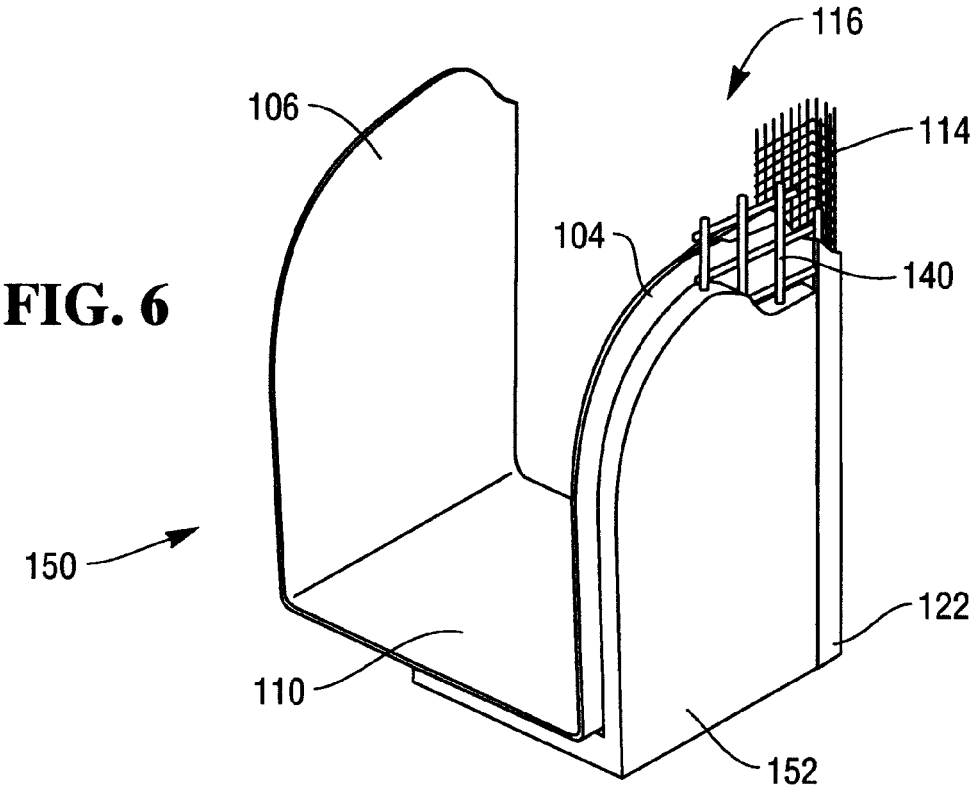
FIG. 6 is a rear perspective view of a secure enclosure body comprising the molded plastic shell body of FIG. 2 having polymer concrete bonded to an external surface thereof after another step of the process of FIG. 1, with parts of the plastic removed to reveal the mesh reinforcement of FIG. 3 and the additional reinforcement of FIG. 5.

The next step in the process (step 30) is to wait for the polymer concrete to set sufficiently. Once this has occurred, the concrete mould (not shown) can be removed (step 32) leaving a secure enclosure body 150, as illustrated in FIG. 6, comprising the molded plastic shell body 100, the mesh reinforcement 114, the additional reinforcement 140, and a layer of polymer concrete 152 covering the rear wall 102 (not shown in FIG. 6) and the four sidewalls 104,106,108 (not shown in FIG. 6),110.

The channel 124 (best seen in FIG. 4) provides an area for the polymer concrete 152 to bind securely to the molded plastic shell body 100. The ribs 112 also provide keying for the polymer concrete 152 to improve adhesion to the molded plastic shell body 100. Furthermore, since the molded plastic shell body 100 comprises a plastic material, there is a strongly adhesive bond between the polymer concrete 152 and the molded plastic shell body 100.

In some embodiments, a conventional safe door may be coupled to the secure enclosure body 150 to provide a secure enclosure. However, in this embodiment, a secure enclosure door is fabricated for coupling to the secure enclosure body 150, as will now be described with reference to FIG. 7.

Figure 7:
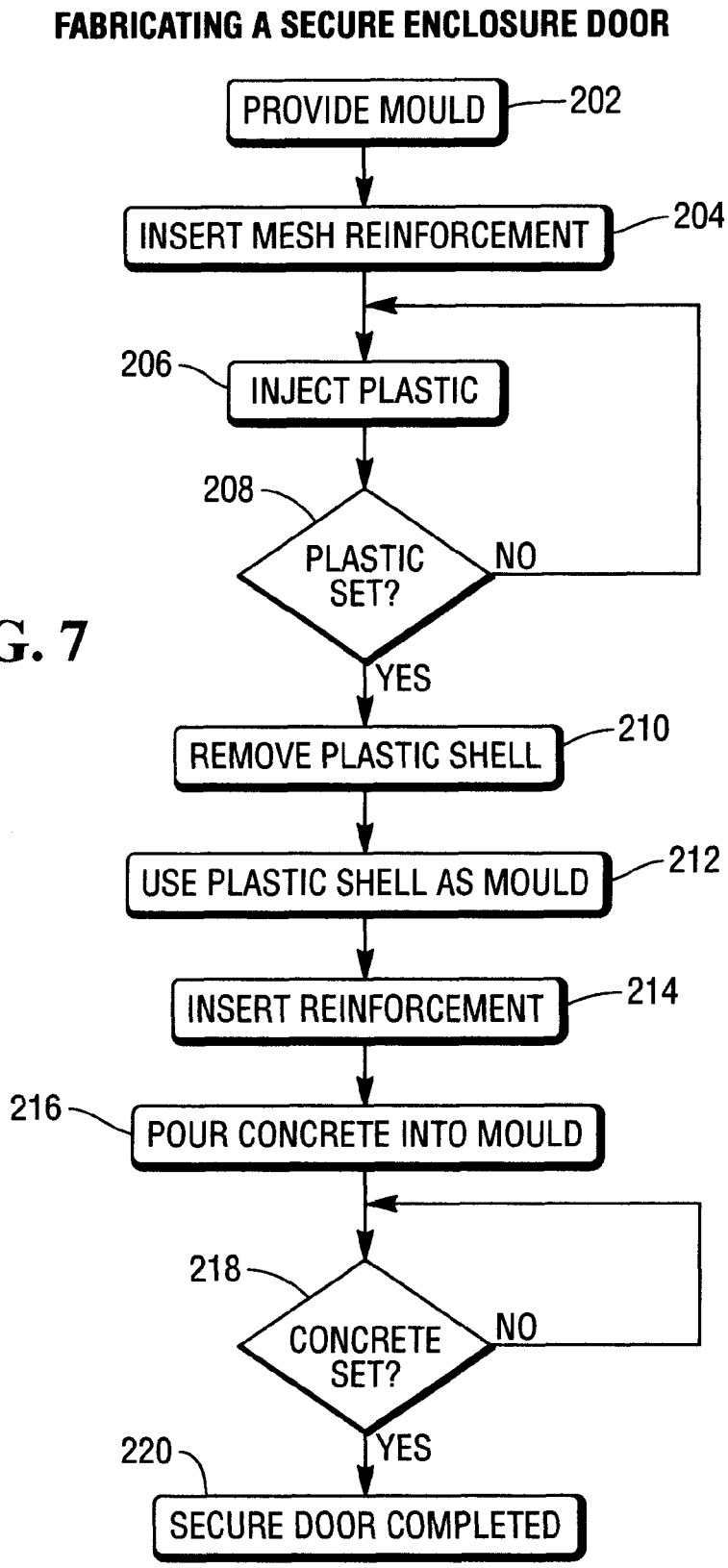
FIG. 7 is a flowchart illustrating process steps used to fabricate a secure enclosure door leaf for coupling to the secure enclosure body of FIG. 6.

FIG. 7 illustrates a flowchart 200 illustrating the process steps used to fabricate a secure enclosure door leaf. The steps of flowchart 200 are very similar to the steps of flowchart 10.

The first step (step 202) in the process is to provide a door shell mould (not shown) defining a cavity (not shown).

The next step (step 204) is to insert a mesh reinforcement (not shown) into the cavity (not shown). Once the mesh reinforcement (not shown) is in place, the next step (step 206) is to inject molten plastic (polycarbonate in this embodiment) into the cavity (not shown).

Figure 8:
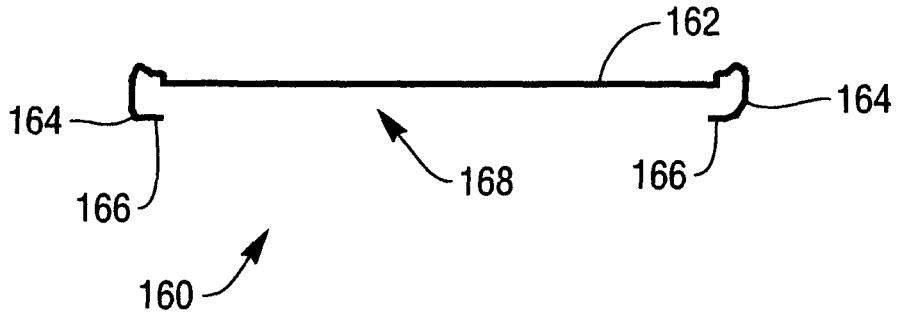
FIG. 8 is a simplified end view of a secure enclosure door shell resulting from an injection-molding step of the process of FIG. 7.
Figure 9:
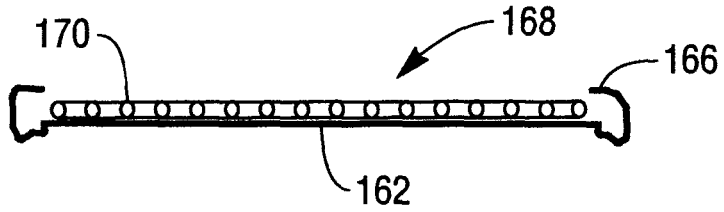
FIG. 9 is a simplified end view of a secure enclosure door shell resulting from a reinforcement insertion step of the process of FIG. 7.

The molten plastic is then allowed to set (step 208). Once set, the mould is then removed (step 210) to reveal a secure enclosure door shell 160 as illustrated in FIG. 8. The secure enclosure door shell 160, referred to herein as a door leaf shell.

The door leaf shell 160 corresponds to the shape defined by the cavity (not shown), and comprises a rear wall 162 defining a continuous curved protrusion 164 at each of its four edges (the top and bottom edges are removed in FIG. 8 for clarity). The curved protrusion 164 is dimensioned to extend beyond and partially surround the protrusion 122 of the secure enclosure body 150, when the door leaf shell 160 is coupled thereto. The curved protrusion 164 allows the door leaf shell 160 to be hung on either side of the secure enclosure body 150.

The curved protrusion 164 also provides a flange portion 166. This flange portion 166 serves a similar purpose to the flange 126 of the protrusion 122, as will be described below.

The next step in the process is to use the door leaf shell 160 as a mould into which polymer concrete is poured (step 212). This is implemented by resting the door leaf shell 160 on its rear wall 162. The curved protrusion 164 and the rear wall 162 combine to define a cavity 168 into which polymer concrete is poured.

Figure 10:
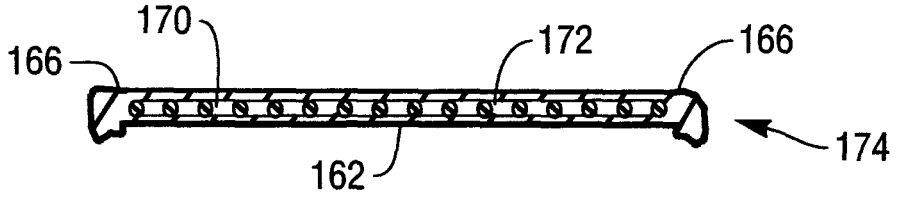
FIG. 10 is a simplified end view of a secure enclosure door shell resulting from a concrete pouring step of the process of FIG. 7.

Reference will now also be made to FIG. 10, which is a simplified end view of the door leaf shell 160 (with the top and bottom removed for clarity) after a reinforcement insertion step.

In the reinforcement insertion step, an additional reinforcement 170 (of similar type and dimensions to the additional reinforcement 140) is inserted into the cavity 168.

Reference will now also be made to FIG. 10, which is a simplified cross-sectional end view of the molded plastic door panel 160 (the top and bottom have been removed for clarity) after a concrete pouring step.

Once the additional reinforcement 170 has been inserted, the next step in the process is the concrete pouring step (step 216). This involves pouring polymer concrete 172 (FIG. 10) into the cavity 168 until the cavity 168 is filled level with the flange portion 166. Any convenient polymer concrete may be used.

Once the concrete has set (step 218), the result is a secure enclosure door leaf 174 (step 220).

Figure 11:
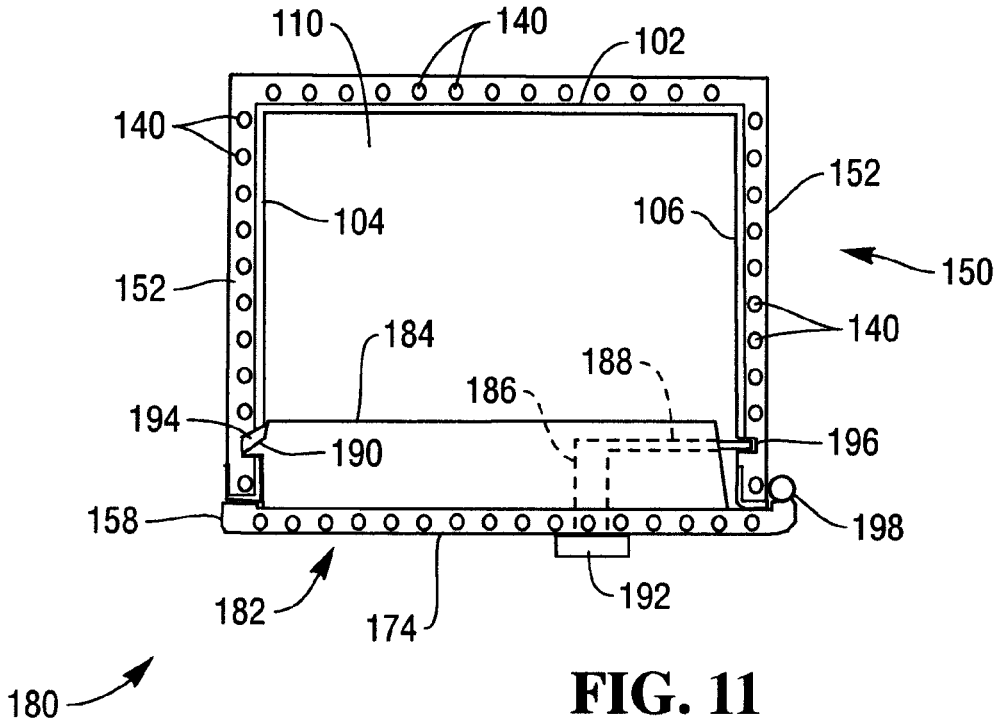
FIG. 11 is a simplified cross-sectional plan view of a secure enclosure comprising the secure enclosure body of FIG. 6 coupled to a secure enclosure door fabricated using the steps shown in FIG. 7.

As is well known in the art, conventional door accessories can be coupled to the door leaf 174, as illustrated in FIG. 11, which is a cross-sectional plan view (for clarity, cross hatching is not shown) of a secure enclosure 180 comprising the secure enclosure body 150 having a secure enclosure door 182 coupled thereto.

The secure enclosure door 182 comprises: the secure enclosure door leaf 174, a boltwork casing 184, which is coupled to the secure enclosure door leaf 174. The boltwork casing 184 encloses a conventional lock mechanism 186, engagement bars 188, and other conventional features of a secure enclosure door. The secure enclosure door 182 also includes an engagement stanchion 190 defined by the boltwork casing 184, and an external handle 192.

Although not described above, the secure enclosure body 150 defines recesses 194, 196 in the vertical sidewalls 104, 106 (and the polymer concrete 62) to accommodate the engagement stanchion 190 and engagement bars 188 respectively.

A hinge 198 is provided to couple the secure enclosure door 182 to the secure enclosure body 150.

It should now be appreciated that an improved secure enclosure fabrication process has been described that allows a composite secure enclosure to be fabricated without using any internal or external metal panels as part of the secure enclosure construction.

Various modifications may be made to the above described embodiment within the scope of the invention, for example, in other embodiments, the molded plastic shell body 100 may be used as a secure enclosure body without having any concrete (polymer or cement) applied thereto. A conventional door may be coupled to this secure enclosure body to provide a business hours safe.

In other embodiments, the mesh reinforcement may comprise any convenient shape (instead of a horizontal and vertical array), and may comprise a metal other than steel, or a non-metal.

In other embodiments, the plastic body may be of different dimensions to those described, for example, it may be thinner or thicker than 6 mm.

In other embodiments, the additional reinforcement may not be used.

In other embodiments, the additional reinforcement may comprise any convenient shape (instead of a horizontal and vertical lattice), may comprise a metal other than steel, or a non-metal, and may comprise any convenient dimensions.

In other embodiments, the step of heating the concrete mould may not be implemented. Alternatively, the step of heating the concrete mould may be implemented prior to and/or during the step of pouring the concrete.

In other embodiments, other quick-setting concretes than polymer concrete may be used. For example, natural concrete may be used.

The steps of the methods described herein may be carried out in any suitable order, or simultaneously where appropriate.

The terms "comprising", "including", "incorporating", and "having" are used herein to recite an open-ended list of one or more elements or steps, not a closed list. When such terms are used, those elements or steps recited in the list are not exclusive of other elements or steps that may be added to the list.

Unless otherwise indicated by the context, the terms "a" and "an" are used herein to denote at least one of the elements, integers, steps, features, operations, or components mentioned thereafter, but do not exclude additional elements, integers, steps, features, operations, or components.

What is claimed is:

1. A secure enclosure comprising:

a secure enclosure body comprising:

a molded plastic shell body comprising a mesh reinforcement enclosed therein; and concrete adhered to the exterior of the molded plastic shell body.

2. A secure enclosure according to claim 1 further comprising:

a secure enclosure door leaf, the secure enclosure body coupled to the secure enclosure door leaf.

3. A secure enclosure according to claim 2, wherein the secure enclosure further comprises:

a boltwork casing coupled to the door leaf, where the boltwork casing encloses a lock mechanism and engagement bars.

4. A secure enclosure according to claim 3, wherein the secure enclosure further comprises a handle coupled to the secure enclosure door leaf.

5. A self-service terminal comprising:

a secure enclosure comprising:

a secure enclosure body comprising a molded plastic shell body comprising a mesh reinforcement enclosed therein, and concrete adhered to the exterior of the molded plastic shell body; and a secure enclosure door leaf coupled to the secure enclosure body; and a dispenser, the dispenser mounted in the secure enclosure.

6. A self-service terminal according to claim 5, wherein the self-service terminal comprises an automated teller machine.

* * * * *